United States Patent [19]

Olcer

[11] 4,141,517

[45] Feb. 27, 1979

[54] APPARATUS FOR ADJUSTING THE LATERAL POSITION OF A ROLLED WEB

[75] Inventor: Behzat Olcer, Ankara, Turkey

[73] Assignee: Martin Automatic, Inc., Rockford, Ill.

[21] Appl. No.: 889,024

[22] Filed: Mar. 22, 1978

[51] Int. Cl.[2] ..... B65H 75/24

[52] U.S. Cl. ..... 242/68.3; 242/72.1; 279/2 R

[58] Field of Search ..... 242/72.1, 68.3, 68.2, 242/72 R, 72 B, 68.4, 57.1; 279/2 R; 269/48.1; 82/44

[56] References Cited

U.S. PATENT DOCUMENTS

| | | | |
|---|---|---|---|
| 1,846,747 | 2/1932 | Stever et al. | 242/72.1 X |
| 2,460,325 | 2/1949 | Whitson et al. | 242/72.1 |
| 3,539,128 | 11/1970 | Chambon | 242/72.1 |
| 3,823,892 | 7/1974 | Glaser | 242/72 |

*Primary Examiner*—Harvey C. Hornsby
*Assistant Examiner*—John M. Jillions
*Attorney, Agent, or Firm*—Allegretti, Newitt, Witcoff & McAndrews

[57] ABSTRACT

Apparatus for adjusting the lateral position of a rolled web includes a spindle on which the rolled web is mounted for rotation. Extensible through openings in the spindle are chuck members for chucking and supporting the rolled web. The chuck members are supported on a laterally shiftable shaft and the lateral position of the rolled web is adjusted by shifting the shaft.

10 Claims, 5 Drawing Figures

APPARATUS FOR ADJUSTING THE LATERAL POSITION OF A ROLLED WEB

BACKGROUND OF THE INVENTION

This invention relates to web guidance apparatus and more particularly, to apparatus for adjusting the lateral position of a rolled web.

In U.S. Pat. No. 3,615,048 issued Oct. 26, 1971, to John R. Martin, apparatus for automatically adjusting the lateral position of a moving web was disclosed. While this apparatus has been highly successful in controlling precisely the lateral position of a moving web, there has remained a need for apparatus by which the gross lateral position of a rolled web placed on an unwind stand may be manually adjusted. In the past, a common practice has been to shift the spindle, or core shaft, on which the roll is chucked.

SUMMARY OF THE INVENTION

In a principal aspect, the present invention comprises a spindle for mounting a rolled web having at least a section thereof defining an inner space and at least one opening to the inner space; a support member mounted within the inner space for lateral shifting thereof in relation to the opening; at least one chuck member supported on the support member and movable through the opening between a retracted position and an extended position relative thereto; means on the support member for moving the chuck member between the retracted position and the extended position; and means for laterally shifting the support member whereby the rolled web may be laterally adjusted when the chuck member is in the extended position.

In another aspect, the present invention comprises apparatus of the type just described for chucking the rolled web as well as adjusting the lateral position thereof.

Thus, it is an object of the present invention to provide apparatus for making gross adjustments in the lateral position of a rolled web.

It is another object of the present invention to provide apparatus for chucking the rolled web as well as adjusting the lateral position thereof.

Another object of the present invention is to provide an unwind stand incorporating the apparatus for chucking and adjusting the lateral position of a rolled web.

These and other objects and advantages of the present invention will become apparent from the description of the preferred embodiment of the invention, which follows.

BRIEF DESCRIPTION OF THE DRAWING

In the detailed description of the preferred embodiment which follows, reference will be made to the drawing wherein.

DETAILED DESCRIPTION OF THE PREFERRED EMBODIMENT

Figure 1:
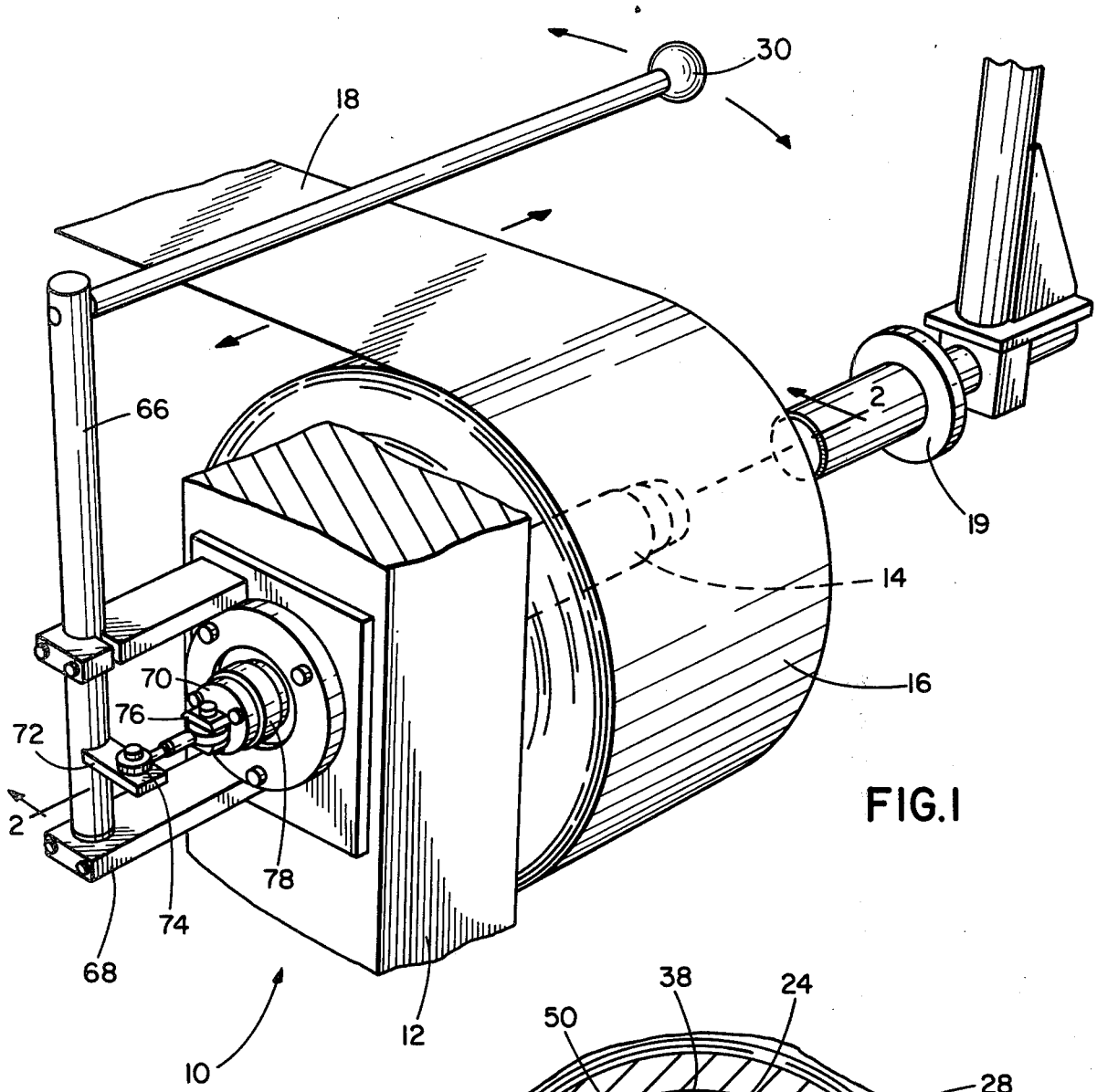
FIG. 1 is a perspective view of the preferred embodiment of the present invention, depicting a roll loaded on the spindle of the preferred embodiment.

Referring to FIG. 1, the apparatus 10 of the preferred embodiment includes an upright base or stand 12 upon which a spindle such as cantilevered spindle 14 is rotatably mounted, for supporting a roll 16 of web material such as paper 18 which is placed on the spindle with conventional mounting apparatus 19. The spindle 14 defines a reference axis, which in the preferred embodiment, lies in a horizontal plane so that the paper 18 may be unwound into equipment (not shown) having horizontal rollers.

Figure 3:
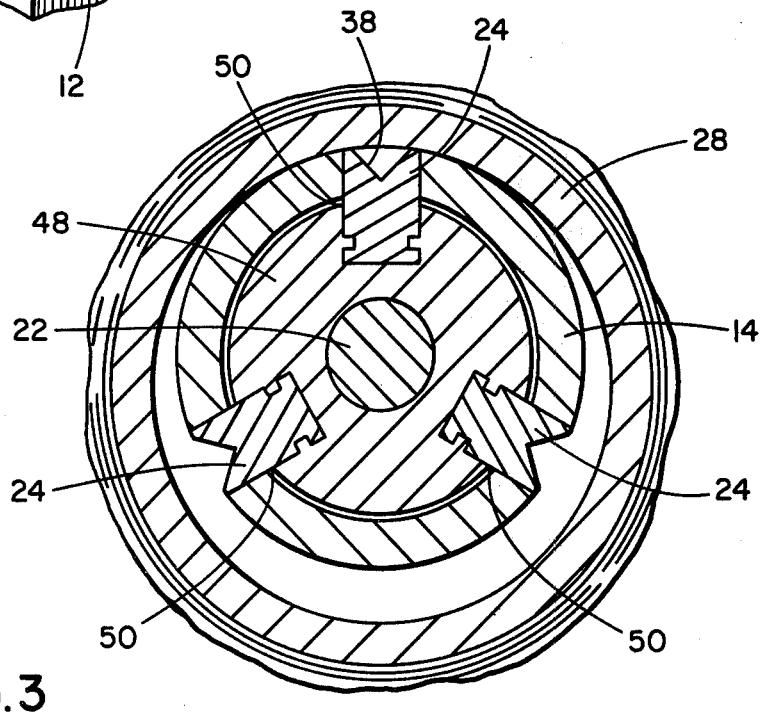
FIG. 3 is a partial cross-sectional view taken along line 3—3 of FIG. 2.
Figure 2:
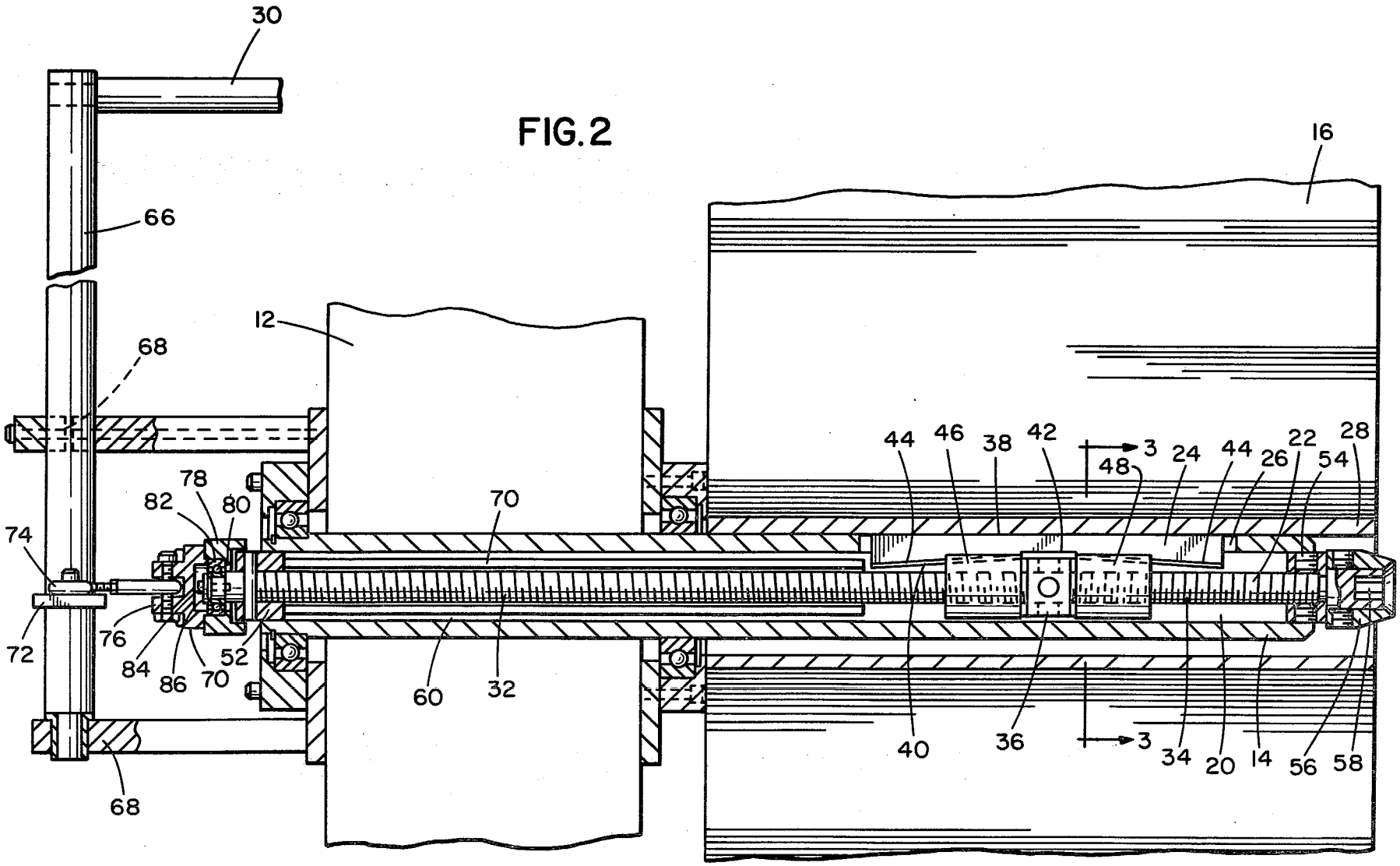
FIG. 2 is a cross-sectional view of the roll and the preferred embodiment of FIG. 1, taken along line 2—2 of FIG. 1.
Figures 4, 5:
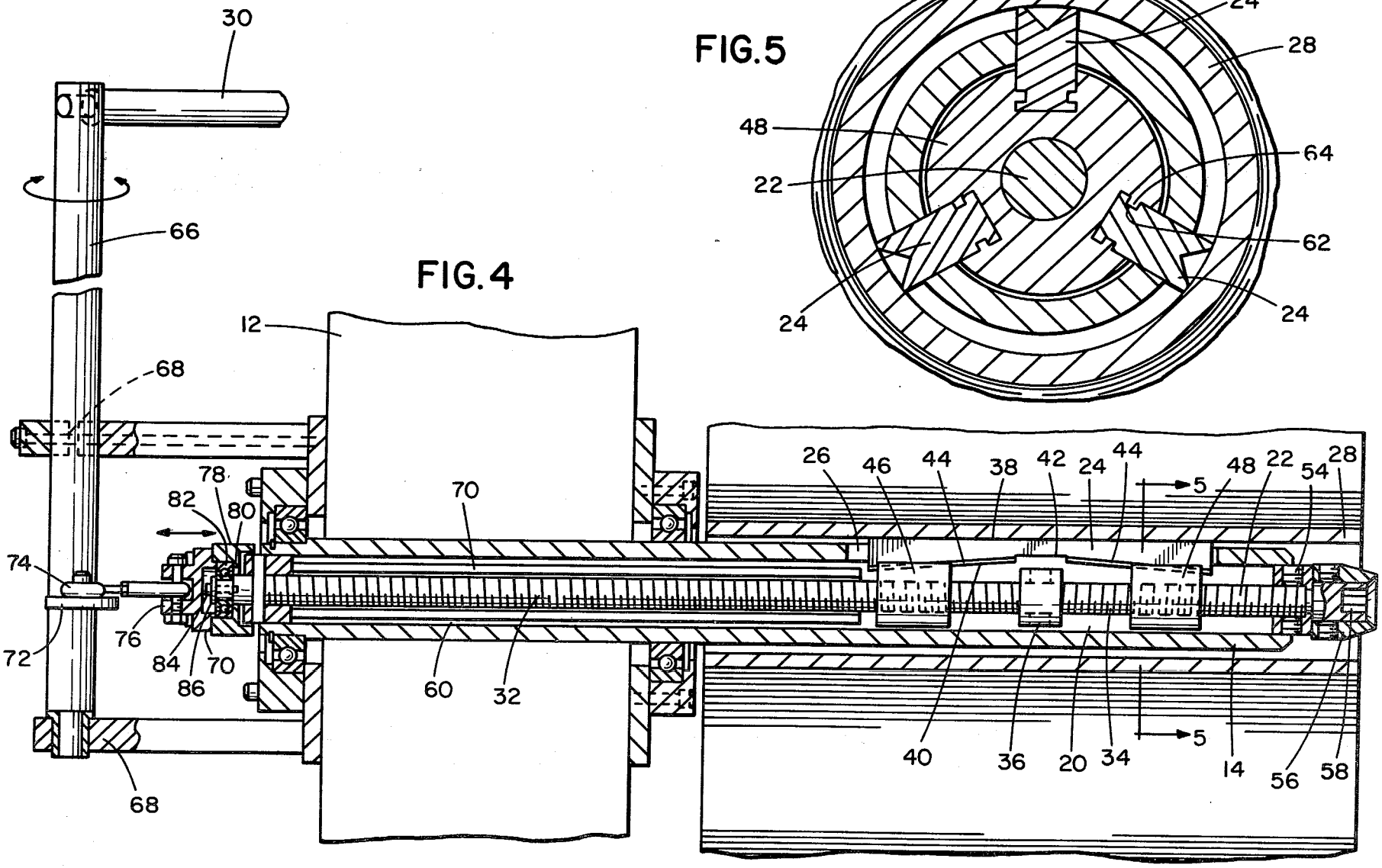
FIG. 4 is a cross-sectional view similar to FIG. 2.
FIG. 5 is a cross-sectional view similar to FIG. 3 taken along line 5—5 of FIG. 4.

The spindle 14 is annular throughout its length, as shown in FIG. 2, thereby defining an internal space such as space 20, which extends the length of the spindle 14. Co-axially aligned with the spindle 14 in the space 20 is a support member such as shaft 22. Supported on the shaft 22 are a plurality of chuck members such as the three circumferentially spaced jaws 24. As will be detailed, the jaws 24 are extensible through openings in the spindle 14 such as elongated slots 26 between a retracted position as shown in FIGS. 2 and 3 and an extended position as shown in FIGS. 4 and 5. In the extended position, the jaws 24 support the core 28 of the roll 16 and lift it off the spindle 14. The roll 16 can then be adjusted laterally by employing the lever 30 to drive the shaft 22 and the jaws 24 axially within the spindle 14.

Referring again to FIG. 2, the shaft 22 has a threaded section 32 and a threaded section 34 joined by a center piece 36. When the jaws 24 are centered within the slots 26, the center piece 36 is positioned at the mid-point of the slots 26. The section 32 has left-handed screw threads traced thereon, and the section 34 has right-handed screw threads traced thereon. The leads of these screw threads are identical.

The jaws 24 are each elongated in a direction parallel to the axis of the shaft 22 and each has a V-shaped upper surface 38, as best shown in FIG. 3, for securely biting into the core 28 when the jaws are in the extended position. Alternatively, the jaws 24 may each have a substantially flat upper surface to avoid damage to the core 28, if material thereof is readily subject to damage. The lower surface 40 of each jaw 24 has an upwardly recessed central section 42. Extending in either direction from the central section 42, the lower surface 40 defines a cam surface 44 that slopes inward, or toward the axis of the shaft 22.

Cooperating with the jaws 24 and the sections 32, 34 to move the jaws 24 between the retracted and extended positions are cam members 46, 48 which are respectively mounted on the sections 32, 34. Each cam member 46, 48 has internal screw threads mating with the threads on the section 32, 34, and each has cam slots 50, detailed in FIG. 3, that cooperate with the cam surfaces 44 of the jaws 24. Thus, if the shaft 22 is rotated in relationship to the spindle 14, the jaws 24 prevent rotation of the cam members 46, 48 and thereby cause the cam members 46, 48 to move axially along the shaft 22.

Because of the oppositely directed screw threads on the sections 32, 34, the cam members 46, 48 move simultaneously toward or away from the center piece 36. As the cam members 46, 48 move away from the center piece 36, the jaws 24 are moved radially outward toward the extended position because of the cooperation of the cam surfaces 44 and the cam slots 50. As the cam members 46, 48 move toward the center piece 36, the jaws 24 are returned to the retracted position. Rotation of the shaft 22 in relation to the spindle 14 thus controls the radial position of the jaws 24.

So that the shaft 22 may be rotated as described, bushings 52, 54 support the shaft 22 at either end of its length within the spindle 14. In addition, a nose piece 56 is secured to the section 34 of the shaft 22. The nose piece 56 forms a fitting 58 into which an Allen wrench (not shown) may be fitted to rotate the shaft 22. As shown in FIG. 4, a sleeve 70 positioned on the section 32 of the shaft 22 prevents the cam members 46, 48 from travelling too far along the sections 32, 34; and, as shown in FIG. 5, cooperative channels 62 and flanges 64 on the jaws 24 and the cam members 46, 48, respectively, retain the jaws 24 on the cam members 46, 48.

The mechanism for laterally adjusting the position of the roll 16 is now described. As shown in FIG. 2, the slots 26 are longer axially than the jaws 24 and the jaws 24 abut the center piece 36. Thus, with the jaws extended to chuck the roll 16, the lateral position of the roll 16 may be adjusted by moving the jaws 24 within the slots 26. The shaft 22 is supported within the spindle 14 by bushings 52, 54 and thus the shaft 22, the cam members 46, 48 and the jaws 24 can be slid as a unit within the spindle 14.

As stated, the lever 30 may be employed to drive the shaft 22 axially within the spindle 14. That is, the upright lever extension 66, which is rotatably mounted on the stand 12 by bearings 68, is linked by linkage 70 to the shaft 22. As detailed in FIG. 4, the linkage 70 includes a bracket 72 which is connected by link 74 to a cartridge 76. The cartridge 76 is bolted to a retainer ring 78, which has a flange 80 extending inward towards the shaft 22. Retained between the retainer ring 78 and the cartridge 76 is a bearing 82, which is secured to the shaft 22 by a bolt 84 and a washer 86. Pivotal movement of the operating lever 30 thus pivots the extension 66 in the bushings 68 and pivots the bracket 72. If the bracket 72 is pivoted away from the stand 12, the cartridge 76 and the retainer ring 78 pull the shaft 22 and thereby the roll 16 toward the stand 12. If the bracket 76 is pivoted toward the stand 12, the roll 16 is moved in the opposite direction.

From the foregoing, it should be apparent to those having skill in the art that highly useful apparatus for chucking and adjusting the lateral position of a rolled web has been described herein. In a commercial embodiment, this apparatus has been constructed to allow for a lateral adjustment of one-and-one-quarter inches, which has been found sufficient for installations associated with printing press equipment.

It should also be apparent that modifications or changes could be made in the design of the apparatus described in this application. For example, the apparatus could be modified for automatic operation. Thus, the detailed description of the preferred embodiment is intended as illustrative and not restrictive. All changes which come within the meaning and range of equivalency of the claims are intended to be embraced therein.

What is claimed is:

1. Apparatus for adjusting the lateral position of a rolled web, said apparatus comprising, in combination:

a spindle for mounting said rolled web having at least a section thereof defining an inner space and at least one opening to said inner space;

a support member mounted within said inner space for lateral shifting thereof in relation to said opening;

at least one chuck member supported on said support member and movable through said opening between an extended position and a retracted position relative thereto;

means on said support member for moving said chuck member between said extended position and said retracted position; and means for laterally shifting said support member whereby said rolled web may be laterally adjusted when said chuck member is in said extended position.

2. Apparatus as claimed in claim 1 wherein said spindle section defines a plurality of openings, and including a plurality of chuck members each movable through one of said openings.

3. In a stand for unwinding a rolled web, apparatus for chucking the rolled web and adjusting the lateral position thereof, said apparatus comprising, in combination:

a spindle rotatably mounted on said stand having at least a section thereof defining an inner space and a plurality of openings to said inner space;

a support member mounted within said inner space for lateral shifting thereof in relation to said openings;

a plurality of chuck members supported on said support member and each movable through one of said openings between an extended position and a retracted position relative thereto, said chuck members in said extended position chucking said rolled web for rotation with said spindle;

means on said support member for moving said chuck members between said extended position and said retracted position; and means for laterally shifting said support member whereby said rolled web may be laterally adjusted when said chuck members are in said extended position.

4. Apparatus as claimed in claim 3 wherein said moving means includes at least one cam member.

5. Apparatus as claimed in claim 3 further comprising means for laterally driving said cam member.

6. Apparatus as claimed in claim 5 wherein said driving means includes cooperative threads defined on said support member and on said cam member.

7. Apparatus as claimed in claim 4 wherein said cam member and said chuck members include cooperative cam surfaces.

8. Apparatus as claimed in claim 4 including two cam members each moving each of said chuck members.

9. Apparatus as claimed in claim 3 wherein said support member is slidably mounted within said inner space.

10. Apparatus as claimed in claim 3 wherein said means for laterally shifting said support member includes a manually actuated lever.

* * * * *